US007575441B1

(12) United States Patent
Huang et al.

(10) Patent No.: US 7,575,441 B1
(45) Date of Patent: Aug. 18, 2009

(54) BOARD-TO-BOARD CONNECTOR ASSEMBLY

(75) Inventors: Sheng-Yuan Huang, Tu-Cheng (TW); Sheng-Tsung Yuan, Tu-Cheng (TW); Yung-Chi Peng, Tu-Cheng (TW)

(73) Assignee: Cheng Uei Precision Industry Co., Taipei Hsien (TW)

( * ) Notice: Subject to any disclaimer, the term of this patent is extended or adjusted under 35 U.S.C. 154(b) by 0 days.

(21) Appl. No.: 12/346,468

(22) Filed: Dec. 30, 2008

(51) Int. Cl.
*H01R 12/00* (2006.01)

(52) U.S. Cl. ..... 439/74

(58) Field of Classification Search ..... 439/74, 439/71, 70, 330, 331, 525, 526
See application file for complete search history.

(56) References Cited

U.S. PATENT DOCUMENTS 6,464,515 B1 * 10/2002 Wu ..... 439/108
6,976,853 B2 * 12/2005 Goto ..... 439/74
6,986,670 B2 * 1/2006 Okura et al. ..... 439/74
7,070,423 B2 * 7/2006 Zhang et al. ..... 439/74
7,128,581 B2 * 10/2006 Igarashi et al. ..... 439/74

* cited by examiner

*Primary Examiner*—Neil Abrams
*Assistant Examiner*—Phuong Nguyen

(57) ABSTRACT

A board-to-board connector assembly includes a receptacle connector and a plug connector mated with the receptacle connector. The receptacle connector includes a receptacle housing having two fixing channels therein and a plurality of first terminals disposed in the receptacle housing. The plug connector includes a plug housing having two fixing ribs and a plurality of second terminals disposed in the plug housing. Each of the second terminals has a bar-shaped base portion and a soldering portion extending from one end of the base portion. The base portion is propped against the corresponding fixing rib and the soldering portion stretches out of the corresponding fixing rib. When the plug connector is engaged with the receptacle connector, the fixing rib is buckled into the corresponding fixing channel and the first terminals contact the corresponding second terminals electrically.

5 Claims, 5 Drawing Sheets

BOARD-TO-BOARD CONNECTOR ASSEMBLY

BACKGROUND OF THE INVENTION

1. Field of the Invention

The present invention generally relates to an electrical connector, and more particularly to a board-to-board connector assembly.

2. The Related Art

Referring to FIG. 5, a conventional board-to-board connector assembly 100' includes a receptacle connector 10' and a plug connector 20'. The receptacle connector 10' has a receptacle housing 11' and a plurality of first terminals 12' disposed in the receptacle housing 11' respectively. The plug connector 20' has a plug housing 21' and a plurality of second terminals 22' disposed in the plug housing 21' respectively. Each of the second terminals 22' has a bar-shaped base portion 221' and a soldering portion 222' extended from one end of the base portion 221'. When the plug connector 20' is engaged with the receptacle connector 10', the plug housing 21' is mated with the receptacle housing 11' and the first terminals 12' electrically abut against the corresponding second terminals 22'. The base portions 221' and the soldering portions 222' of the second terminals 22' stretch out of the plug housing 21' for making the soldering portions 222' soldered to a printed circuit board (not shown).

However, the plug connector 20' is engaged with the receptacle connector 10' merely by means of the first terminals 12' and the corresponding second terminals 22' abutting against each other. As a result, when the board-to-board connector assembly 100' is shaken in use, the plug connector 20' is apt to fall off the receptacle connector 10' such that results in an unsteady electrical connection between the first terminals 12' and the corresponding second terminals 22'. Furthermore, the base portions 221' of the second terminals 22' freely stretch out of the plug housing 21' such that results in a bad coplanarity of the soldering portions 222' and a difficult and unsteady soldering between the soldering portions 222' and the printed circuit board. Therefore, a board-to-board connector assembly capable of overcoming the above-mentioned problems is required.

SUMMARY OF THE INVENTION

An object of the present invention is to provide a board-to-board connector assembly which includes a receptacle connector having a receptacle housing and a plurality of first terminals, and a plug connector mated with the receptacle connector and having a plug housing and a plurality of second terminals. The receptacle housing has a base board disposed levelly and two second sidewalls extending upward from two opposite sides of the base board. A receiving recess is formed between the second sidewalls. A top surface of each of the second sidewalls defines a fixing channel parallel the receiving recess and penetrating through two opposite ends thereof. Each of the second sidewalls further defines a plurality of first passageways communicating with the receiving recess. The first terminals are received in the corresponding first passageways and stretch into the receiving recess. The plug housing has a base plate disposed levelly, two fixing ribs extending downward from two opposite sides of the base plate, and an inserting wall extending downward from a middle of the base plate and parallel to and higher than the fixing ribs. The plug housing defines a plurality of second passageways in the inserting wall and the base plate. Each of the second passageways penetrates through the corresponding fixing rib. The second terminals are received in the corresponding second terminals and each has a bar-shaped base portion and a soldering portion extending from one end of the base portion. The base portion is propped against the corresponding fixing rib and the soldering portion stretches out of the corresponding fixing rib. When the plug connector is engaged with the receptacle connector, the inserting wall is inserted in the receiving recess and the fixing rib is buckled into the corresponding fixing channel, the first terminals contact the corresponding second terminals electrically.

As described above, the fixing rib of the plug connector is buckled in the corresponding fixing channel of the receptacle connector in order to ensure the plug connector rightly and steadily engaged with the receptacle connector and further ensure a steady electrical connection between the first terminals and the corresponding second terminals. Moreover, the base portions of the second terminals are propped against the corresponding fixing ribs to ensure a good coplanarity of the soldering portions so as to facilitate the soldering portions to be steadily soldered to a printed circuit board.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
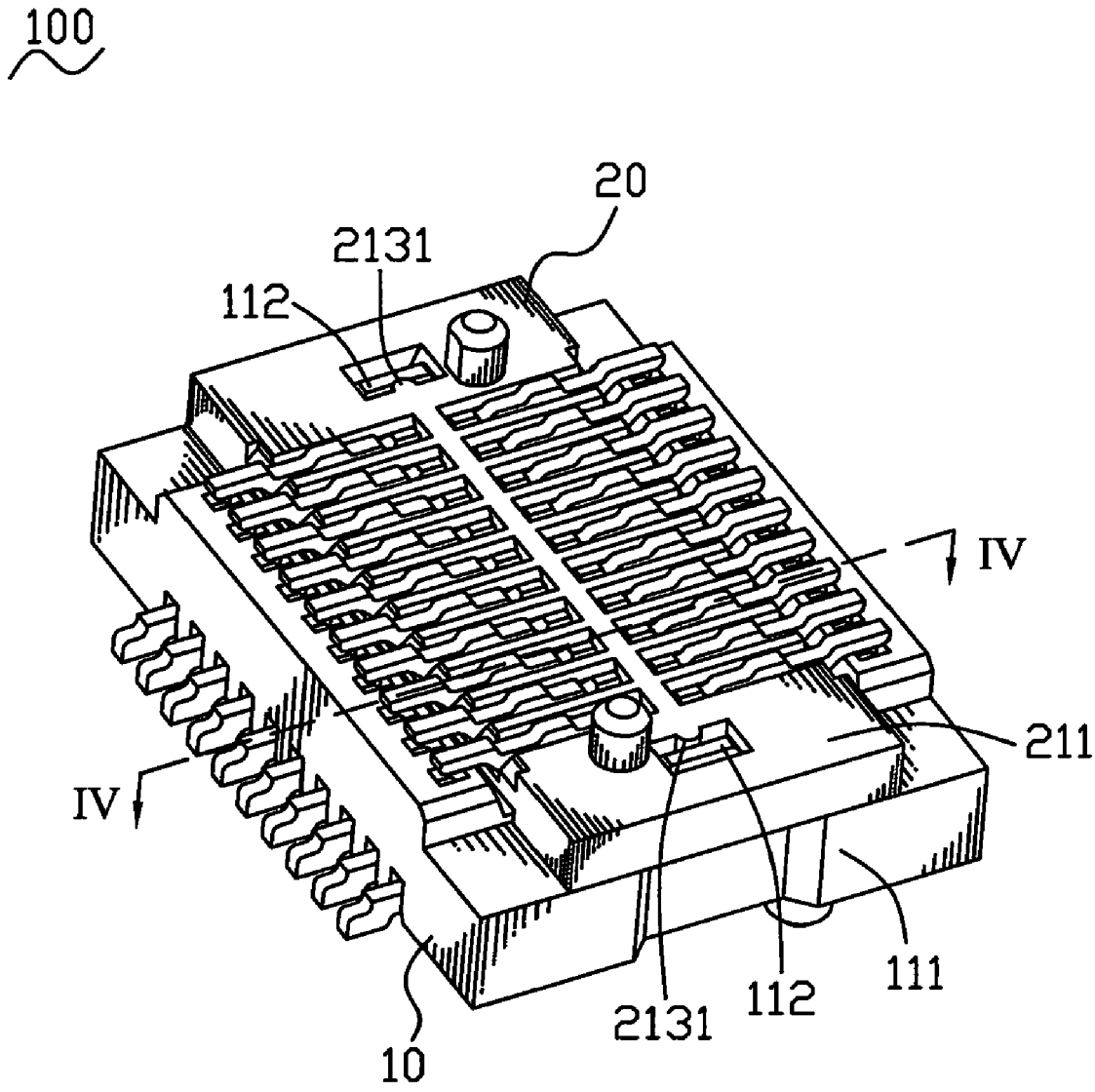
FIG. 1 is a perspective view of a board-to-board connector assembly in accordance with the present invention.

With reference to FIG. 1, a board-to-board connector assembly 100 in accordance with the present invention includes a receptacle connector 10 and a plug connector 20 mated with the receptacle connector 10.

Figure 2:
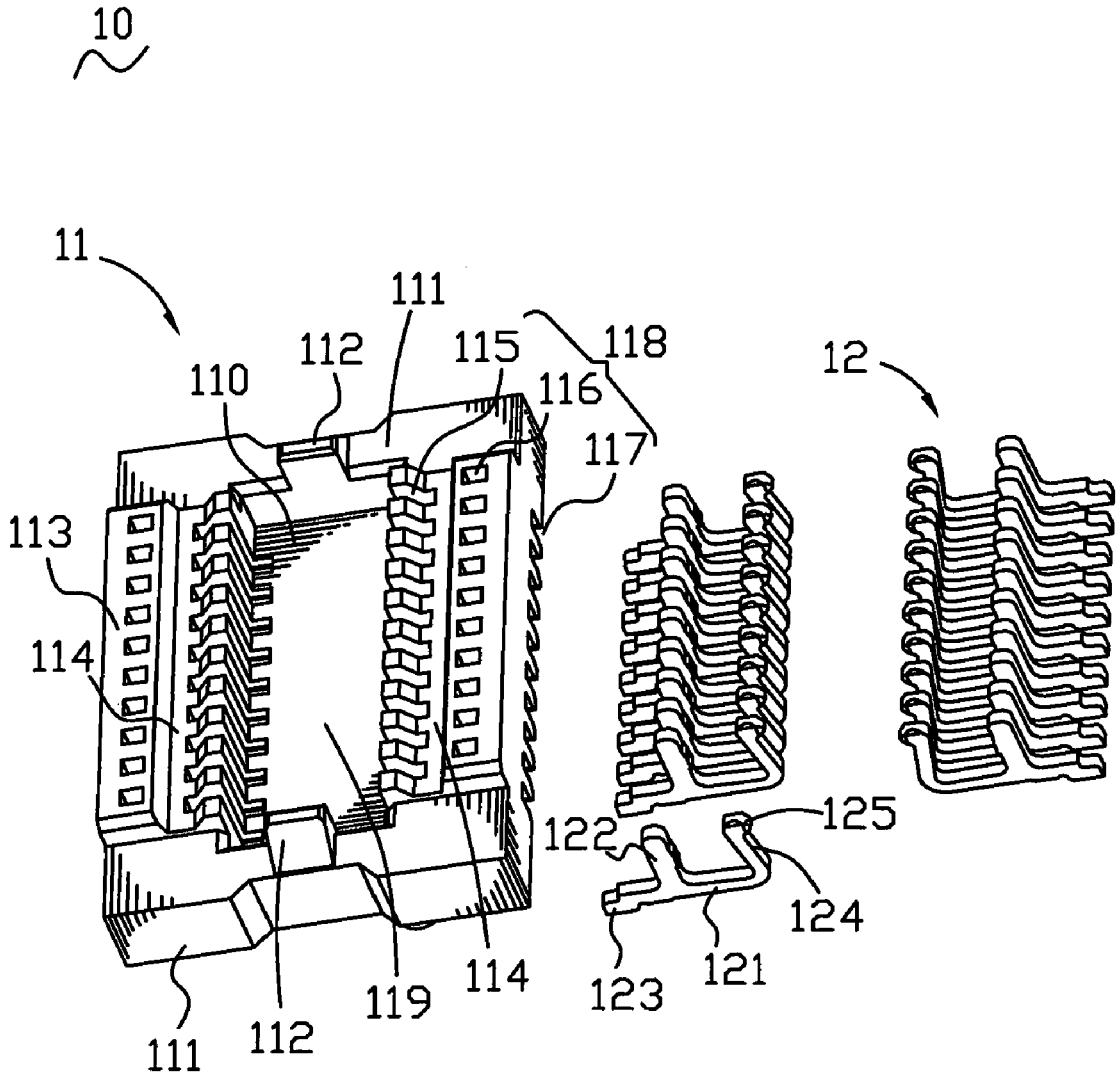
FIG. 2 is an exploded view of a receptacle connector of the board-to-board connector assembly of FIG. 1.
Figure 4:
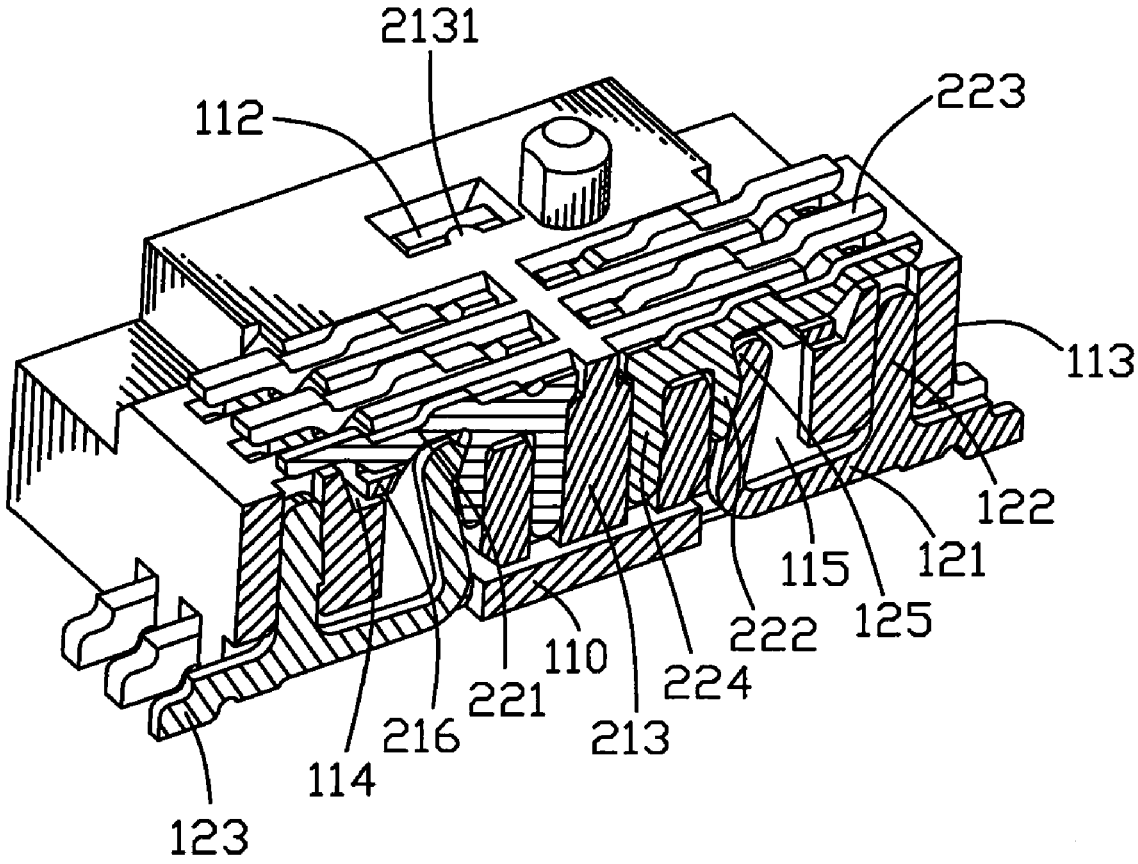
FIG. 4 is a cross-sectional view of the board-to-board connector assembly along line IV-IV of FIG. 1.
Figure 5:
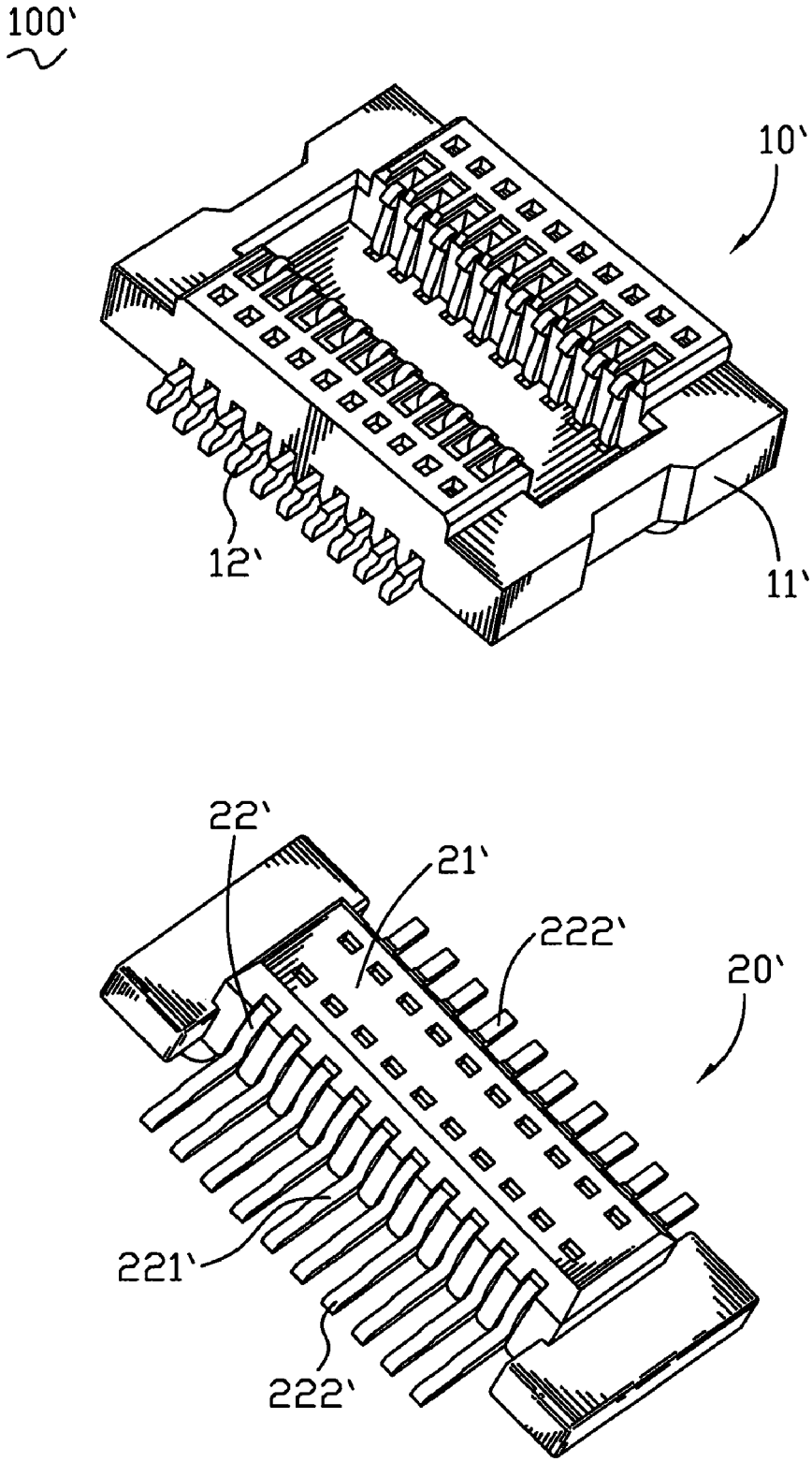
FIG. 5 is a perspective view of a conventional board-to-board connector assembly.

Referring to FIG. 2 and FIG. 4, the receptacle connector 10 includes a receptacle housing 11 and a plurality of first terminals 12 disposed in the receptacle housing 11 respectively.

The receptacle housing 11 has a rectangular base board 110 disposed levelly. Two opposite ends of the base board 110 extend upward to form a pair of first sidewalls 111. Two opposite sides of the base board 110 extend upward to form a pair of second sidewalls 113 extending longwise and slightly higher than the first sidewalls 111. Accordingly, a rectangular receiving recess 119 is formed among the base board 110, the first sidewalls 111 and the second sidewalls 113. A middle of each of the first sidewalls 111 protrudes upward to form a right-trapezoid guiding block 112, of which a vertical surface opposite to an inclined surface is located in the same plane with an inside surface of the corresponding first sidewall 111. A top surface of each of the second sidewalls 113 defines a fixing channel 114 extending longwise to pass through two ends of the corresponding second sidewall 113 and having an inverse trapezoid cross-section. An inside of each of the second sidewalls 113 defines a plurality of receiving cavities 115 arranged at regular intervals along a longwise direction thereof and communicating with the receiving recess 119 and the corresponding fixing channel 114. Each of the receiving cavities 115 extends vertically to pass through the corresponding second sidewall 113. Each of the second sidewalls 113 further defines a plurality of fixing perforations 116 arranged at regular intervals along the longwise direction thereof and apart from the receiving cavities 115 by the corresponding fixing channel 114. Each of the fixing perforations 116 extends vertically to penetrate through the corresponding second sidewall 113. A bottom surface of each of the second sidewalls 113 defines a plurality of receiving grooves 117 each extending transversely to connect the receiving cavity 115 and the corresponding fixing perforation 116 and penetrating through an outside of the corresponding second sidewall 113. The receiving cavity 115, the corresponding fixing perforation 116 and the corresponding receiving groove 117 together define a first passageway 118.

Each of the first terminals 12 has a bar-shaped first base portion 121 extending transversely. One end of the first base portion 121 extends upward to form a first fixing portion 122 and extends transversely and protrudes downward to form a first soldering portion 123. The other end of the first base portion 121 extends upward and inclines toward the first fixing portion 122 to form an elastic portion 124. A free end of the elastic portion 124 protrudes oppositely to the first fixing portion 122 to form a contact portion 125.

When the receptacle connector 10 is to be assembled, the first terminals 12 are received in the corresponding first passageways 118 of the receptacle housing 11. The first base portion 121 is received in the corresponding receiving groove 117. The first fixing portion 122 is inserted in the corresponding fixing perforation 116. The elastic portion 124 is received in the corresponding receiving cavity 115 and the contact portion 125 stretches into the receiving recess 119. The first soldering portion 123 stretches out of the corresponding second sidewall 113 for being soldered to a printed circuit board (not shown).

Figure 3:
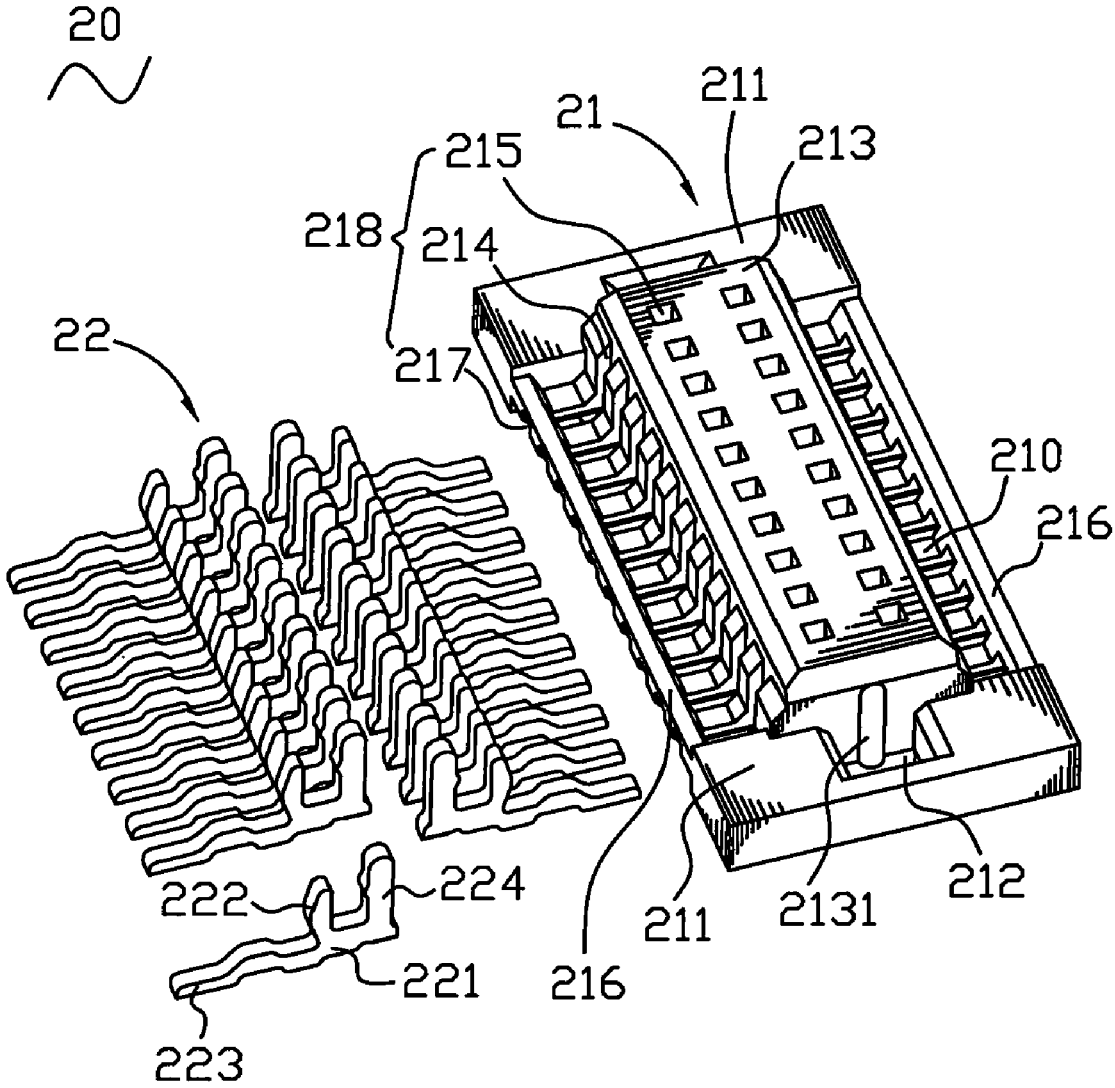
FIG. 3 is an exploded view of a plug connector of the board-to-board connector assembly of FIG. 1.

Referring to FIG. 3 and FIG. 4, the plug connector 20 includes a plug housing 21 mated with the receptacle housing 11 and a plurality of second terminals 22 disposed in the plug housing 21 respectively.

The plug housing 21 has a rectangular base plate 210 disposed levelly. Two opposite ends of the base plate 210 slightly extends downward to form a pair of end-walls 211. Two opposite sides of the base plate 210 slightly protrude downward to form a pair of fixing ribs 216 each extending longwise to connect two corresponding ends of the two end-walls 211. A middle of the base plate 210 extends downward to form a rectangular inserting wall 213 extending longwise to connect the two end-walls 211 and higher than the two end-walls 211. A middle of each of the end-walls 211 defines a right-trapezoid guiding hole 212 vertically passing therethrough. A vertical side opposite to an inclined side of each of the guiding holes 212 is adjacent to a corresponding end surface of the inserting wall 213. A middle of each end surface of the inserting wall 213 protrudes outward into the corresponding guiding hole 212 to form a propping bar 2131 of semi-cylinder shape extending vertically. Two opposite sides of the inserting wall 213 respectively define a plurality of receiving trenches 214 arranged at regular intervals along a longwise direction thereof and each extending vertically to pass therethrough. The inserting wall 213 further defines two rows of fixing apertures 215 one-to-one correspondence to the receiving trenches 214 and each extending vertically to penetrate through the inserting wall 213. Two sides of the base plate 210 respectively define a plurality of receiving fillisters 217 each extending transversely to connect the receiving trench 214 and the corresponding fixing aperture 215 and penetrating through the corresponding fixing rib 216. The receiving trench 214, the corresponding fixing aperture 215 and the corresponding receiving fillister 217 together define a second passageway 218.

Each of the second terminals 22 has a bar-shaped second base portion 221 extending transversely. One end of the second base portion 221 extends downward to form a second fixing portion 224 and the other end thereof protrudes upward and extends transversely to form a second soldering portion 223. A middle of the second base portion 221 extends downward to form a contact arm 222 having a middle protruded oppositely to the second fixing portion 224.

When the plug connector 20 is to be assembled, the second terminals 22 are received in the corresponding second passageways 218 of the plug housing 21. The second base portion 221 is received in the corresponding receiving fillister 217 and propped against the corresponding fixing rib 216. The second fixing portion 224 is inserted in the corresponding fixing aperture 215. The contact arm 222 is received in the corresponding receiving trench 214 and the middle thereof stretches out of the inserting wall 213. The second soldering portion 223 stretches out of the corresponding fixing rib 216 for being soldered to another printed circuit board (not shown). When the second soldering portions 223 are soldered to the corresponding printed circuit board, the fixing ribs 216 can prevent the melted solder from flowing onto the contact arms 222, and moreover, the second base portions 221 are propped against the corresponding fixing ribs 216 that can ensure a good coplanarity of the second soldering portions 223 for facilitating the second soldering portions 223 to be steadily soldered to the corresponding printed circuit board.

Referring to FIG. 1 and FIG. 4, when the plug connector 20 is engaged with the receptacle connector 10, the guiding block 112 is inserted into the corresponding guiding hole 212, the inserting wall 213 is received in the receiving recess 119 and the propping bar 2131 abuts against the vertical surface of the corresponding guiding block 112 and the inside surface of the corresponding first sidewall 111. Each of the end-walls 211 is located on the corresponding first sidewall 111. The contact portion 125 of each of the first terminals 12 electrically abuts against the contact arm 222 of the corresponding second terminal 22. The fixing rib 216 is buckled in the corresponding fixing channel 114 so as to further ensure that the plug connector 20 is rightly and steadily engaged with the receptacle connector 10 and further ensure a steady electrical connection between the first terminals 12 and the corresponding second terminals 22.

As described above, the fixing rib 216 of the plug connector 20 is buckled in the corresponding fixing channel 114 of the receptacle connector 10 in order to ensure the plug connector 20 rightly and steadily engaged with the receptacle connector 10 and further ensure the steady electrical connection between the first terminals 12 and the corresponding second terminals 22. Furthermore, the second base portions 221 of the second terminals 22 are propped against the corresponding fixing ribs 216 to ensure the good coplanarity of the second soldering portions 223 so as to facilitate the second soldering portions 223 to be steadily soldered to the corresponding printed circuit board.

What is claimed is:

1. A board-to-board connector assembly, comprising:

a receptacle connector having a receptacle housing having a base board disposed levelly and two second sidewalls extending upward from two opposite sides of the base board, a receiving recess being formed between the second sidewalls, a top surface of each of the second sidewalls defining a fixing channel parallel the receiving recess and penetrating through two opposite ends thereof, each of the second sidewalls further defining a plurality of first passageways communicating with the receiving recess, and a plurality of first terminals received in the corresponding first passageways and stretching into the receiving recess; and a plug connector mated with the receptacle connector and having a plug housing having a base plate disposed levelly, two fixing ribs extending downward from two opposite sides of the base plate, and an inserting wall extending downward from a middle of the base plate and parallel to and higher than the fixing ribs, the plug housing defining a plurality of second passageways in the inserting wall and the base plate, each of the second passageways penetrating through the corresponding fixing rib, and a plurality of second terminals received in the corresponding second terminals and each having a bar-shaped base portion and a soldering portion extending from one end of the base portion, the base portion being propped against the corresponding fixing rib and the soldering portion stretching out of the corresponding fixing rib;

wherein when the plug connector is engaged with the receptacle connector, the inserting wall is inserted in the receiving recess and the fixing rib is buckled into the corresponding fixing channel, the first terminals contact the corresponding second terminals electrically.

2. The board-to-board connector assembly as claimed in claim 1, wherein each of the fixing channels has an inverse trapezoid cross-section.

3. The board-to-board connector assembly as claimed in claim 1, wherein two opposite ends of the base board extend upward to form two first sidewalls slightly lower than the second sidewalls and connecting the second sidewalls, a middle of each of the first sidewalls protrudes upward to form a guiding block, two opposite ends of the base plate extends downward to form two end-walls lower than the inserting wall and connecting the fixing ribs and the inserting wall, a middle of each of the end-walls defines a guiding hole, the guiding block is inserted into the corresponding guiding hole and the end-wall is located on the corresponding first sidewall.

4. The board-to-board connector assembly as claimed in claim 3, wherein each of the guiding blocks is of right-trapezoid shape and a vertical surface opposite to an inclined surface thereof is located in the same plane with an inside surface of the corresponding first sidewall, each of the guiding holes is of right-trapezoid shape and a vertical side opposite to an inclined side thereof is adjacent to a corresponding end surface of the inserting wall.

5. The board-to-board connector assembly as claimed in claim 4, wherein a middle of each end surface of the inserting wall protrudes outward into the corresponding guiding hole to form a propping bar of semi-cylinder shape extending vertically and abutting against the vertical surface of the corresponding guiding block and the inside surface of the corresponding first sidewall.

* * * * *